US005346182A

United States Patent [19]

Kurotobi et al.

[11] Patent Number: 5,346,182

[45] Date of Patent: Sep. 13, 1994

[54] TEEMING TROUGH

[75] Inventors: Manabu Kurotobi; Mutsuo Uchida, both of Osaka, Japan

[73] Assignee: Kubota Corporation, Osaka, Japan

[21] Appl. No.: 78,728

[22] Filed: Jun. 16, 1993

[51] Int. Cl.[5] ..... B22D 41/60

[52] U.S. Cl. ..... 266/78; 266/236; 266/275

[58] Field of Search ..... 266/191, 196, 275, 236, 266/230, 78, 92

[56] References Cited

U.S. PATENT DOCUMENTS 1,625,755 4/1927 Williams et al. ..... 266/191
2,801,162 7/1957 Keeping ..... 266/196
4,177,974 12/1979 Higuchi et al. ..... 266/196
4,426,067 1/1984 Hopkins ..... 266/196

*Primary Examiner*—Scott Kastler
*Attorney, Agent, or Firm*—Joseph W. Farley

[57] ABSTRACT

A teeming trough for pouring molten metal into a mold. Cooling water jackets are formed at both sides of a horizontal body for molten metal teeming. Valves for adjusting cooling water feeds are disposed in cooling water feed paths for supplying cooling water into respective water cooling jackets. A lateral bend of the body at the forward end thereof is detected by a suitable sensor. The valves are controlled on the basis of the result of the sensor detection so that the balance between cooling water feeds to the water cooling jackets may be varied whereby a bend of the body can be corrected.

6 Claims, 6 Drawing Sheets

TEEMING TROUGH

FIELD OF THE INVENTION

The present invention relates to a teeming trough for pouring molten metal into a mold.

BACKGROUND OF THE INVENTION

For centrifugal casting of, for example, a cast iron pipe, it is usual practice to insert a teeming trough into the interior of a rotary mold and pour molten metal from the Forward end of the teeming trough into the mold. Teeming troughs of the type having a solid body and a chute for supplying the molten metal from a triangular ladle into the body have been known in the art. The body is provided at its Forward end with a spout For pouring molten metal into the mold.

After molten metal pouring is done using such a teeming trough, a coating treatment, which also serves for cooling, is carried out such that a blacking liquid comprising an aqueous solution of carbon black and a binder is applied as a mold wash onto the body by being poured From the chute over the entire length of the body. Further, where necessary, the inner surface of the body is brushed with such a mold wash.

Unfortunately, despite such mold wash coating, the body may be subject to lateral bending due to some local thermal expansion difference during the process of molten metal pouring, with the result that positionally proper pouring of molten metal into the mold may be rendered impracticable. In the prior art, therefore, when such a bend is caused to the body, a mold wash is manually applied to the inner surface of the body with a brush by way of adjust coating thereby to correct the bend.

However, such mold wash brushing operation for correcting the bend of the body involves skill and considerable labor.

DISCLOSURE OF THE INVENTION

Accordingly, it is a primary object of the invention to solve the above mentioned problem by making it possible to automatically correct a bend caused to the trough due to any such thermal expansion difference as above noted.

In order to accomplish this object, a teeming trough for pouring molten metal into a mold in accordance with the invention comprises a horizontally extending body for pouring molten metal, water cooling jackets formed at both sides of the body, cooling-water feed paths for supplying cooling water into the water cooling jackets, means for adjusting cooling water feeds in the respective cooling-water feed paths, means for detecting a lateral bend of the body, and means for controling the cooling-water feed adjusting means on the basis of a detection signal from the bend detecting mean.

According to such arrangement, any bend that is caused to the body as a result of the cooling condition going out of balance between opposite sides of the body will be detected by the bend detecting means. Then, on the basis of a detection signal from the bend detecting means, the cooling-water feed adjusting means is controled by the control means so that the balance of cooling water feeds to the water cooling jackets at both sides of the body is varied. Thus, the effect of cooling is rendered unbalanced accordingly between the opposite sides of the body, whereby the bend is corrected.

DESCRIPTION OF THE PREFERRED EMBODIMENTS

Figure 4:
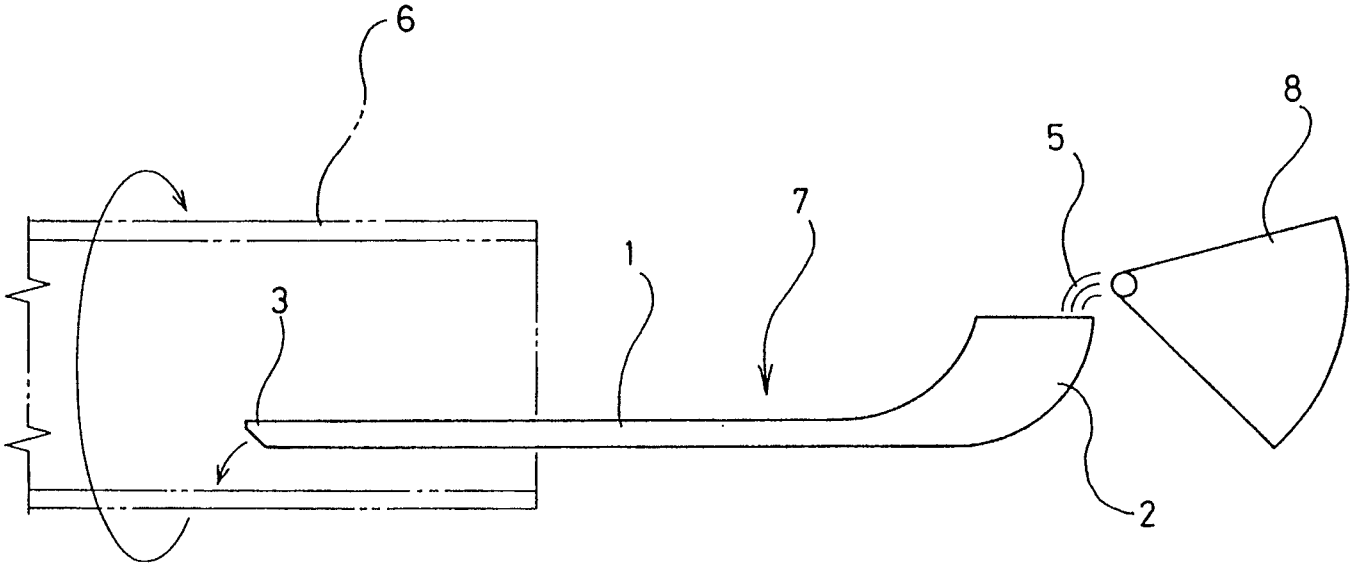
FIG. 4 is a schematic view explaining a casting operation using the teeming trough shown in FIG. 1.

FIGS. 1 through 4 illustrate a first embodiment of the present invention. FIG. 4 schematically shows an installation for centrifigually casting cast steel pipes. Reference numeral 6 designates a horizontal rotary mold into which is inserted a horizontally extending teeming trough 7 according to the invention. The teeming trough 7 includes a body 1, a chute 2 for supplying molten metal 5 from a triangular ladle 8 to the body 1, and a spout 3 located at the forward end of the body 1 for pouring molten metal into the mold 6. The body 1 has a recess 4 formed in the outer surface of its bottom such that an additive feed pipe is disposed in the recess 4 for supplying an additive into the mold 6 immediately prior to supply of molten metal from the spout 3 into the mold.

Figure 1:
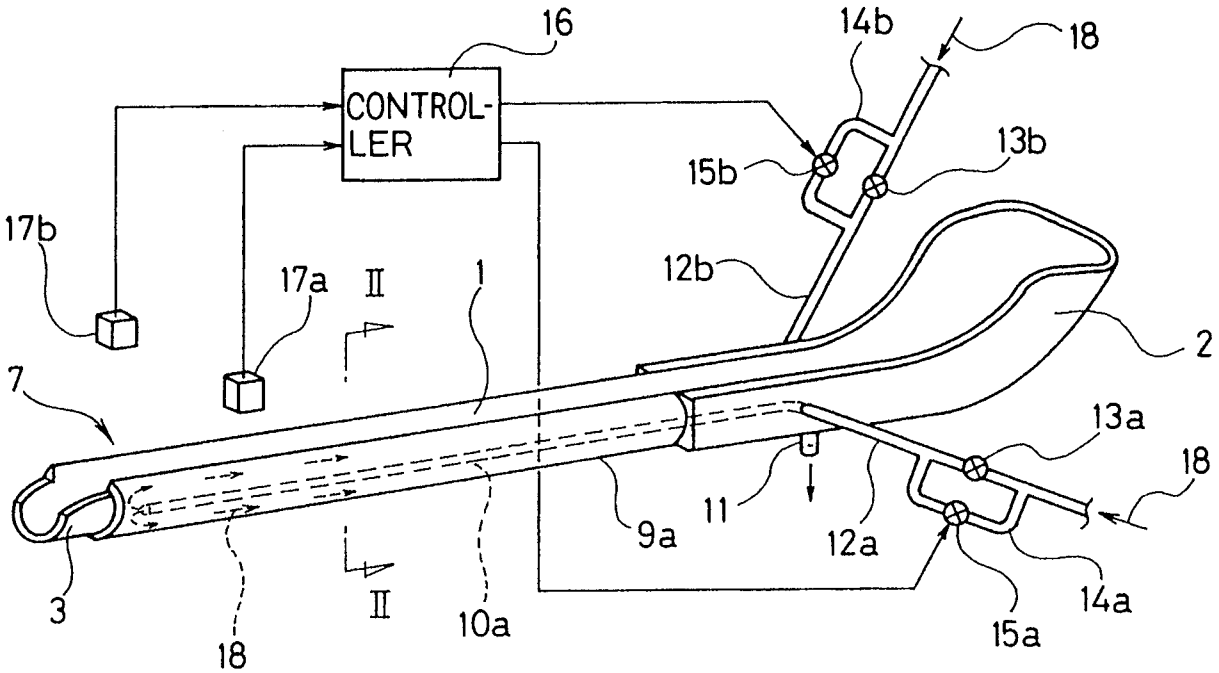
FIG. 1 is a perspective view showing a schematic arrangement of a teeming trough according to a first embodiment of the invention.
Figure 2:
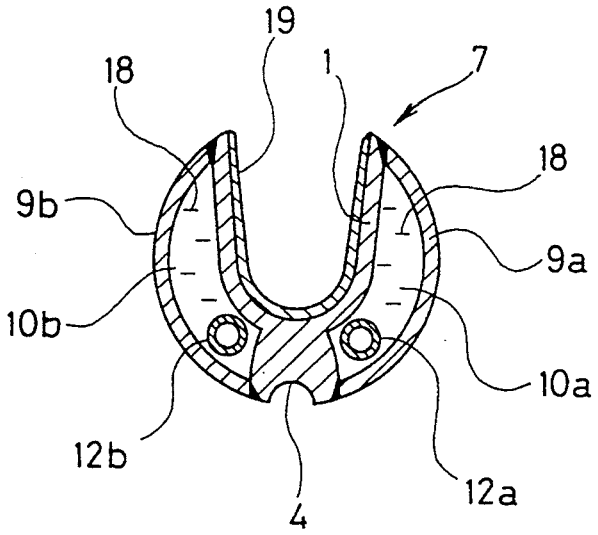
FIG. 2 is a transverse sectional view taken along the line II—II in FIG. 1.
Figure 3:
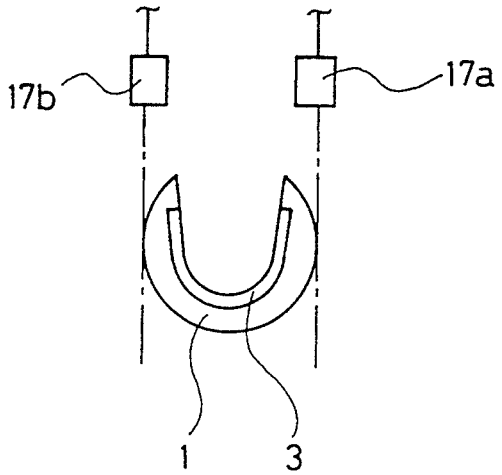
FIG. 3 is an end view showing a forward end portion of the teeming trough shown in FIG.

The body 1 has a cross-sectional configuration of U shape as shown in FIGS. 1 and 2. The body 1 is covered at opposite outer sides thereof with a pair of covers 9*a*, 9*b* having an arcuate sectional configuration, with a pair of water cooling jackets 10*a*, 10*b* enclosed between the body 1 sides and the covers 9*a*, 9*b* which extend along the length of the body 1. Respective ends of the water cooling jackets 10*a*, 10*b* at the forward end of the body 1 are closed. At the base end side of the body 1, the water cooling jackets 10*a*, 10*b* extends into an underside portion of the chute 2 for communication with a cooling water discharge port 11.

At the base end side of the body 1, cooling water feed pipes 12*a*, 12*b* of copper make are fitted respectively into the water cooling jackets from the outside of the trough. The cooling water feed pipes 12*a*, 12*b* extend through the interior of the water cooling jackets 10*a*, 10*b* along the length of the body 1 and are open at the forward end of the body 1. The cooling water feed pipes 12*a*, 12*b* are provided, at locations outside the trough, respectively with flow control valves 13*a*, 13*b*. Bypass flow paths 14*a*, 14*b* are provided in relation to the flow control valves 13*a*, 13*b*, there being provided solenoid-operated on-off valves 15*a*, 15*b* respectively on the bypass flow paths 14*a*, 14*b*. The solenoid operated on-off valves 15*a*, 15*b* may be on-off controlled by a controller 16.

Diffuse reflection-type photoelectric switches 17*a*, 17*b*, as bend detecting means, are disposed above the opposite forward ends of the body 1 so that detection signals from the switches 17*a*, 17*b* may be input to the controller 16.

According to such arrangement, the flow control valves 13*a*, 13*b* are properly controlled during the process of molten metal pouring so that cooling water 18 is caused to flow in the cooling water feed pipes 12*a*, 12*b* while the solenoid operated on-off valves 15*a*, 15*b* are held open. Accordingly, the cooling water 18 flows through the cooling water feed pipes 12*a*, 12*b* toward the forward end of the body 1 and are released from forward end openings of the feed pipes into the water cooling jackets 10*a*, 10*b*. Then, the cooling water 18 flows in those portions of the water cooling jackets 10*a*, 10*b* which are outside the cooling water feed pipes 12*a*, 12*b*, toward the base end of the body 1 while cooling the body 1, until it is discharged out of the system through the cooling water discharge port 11.

In this way, the body 1 is cooled by cooling water 18 over its entire length, so that satisfactory cooling effect can be obtained. During the process of molten metal pouring as well, both the body 1 and the chute 2 can be satisfactorily cooled, and this results in reduced melting loss with respect to portions subject to the effect of molten metal flow. Further, the fact that the cooling water feed pipes 12*a*, 12*b* are open at the forward end of the body 1 permits supply of cooling water of low temperature to the forward end portion of the trough which is likely to be of high temperatures due to its relatively long contact with molten metal, thus enabling that portion to be effectively cooled.

For purposes of molten metal pouring, a graphitic mold wash 19 of the semiparmanent type is coated on the inner surface of the body 1 as well as the surface of the chute 2. In this case, any unevenness in the mold wash 19 coating may render the effect of cooling unbalanced between opposite sides of the body 1 to cause a bend to the body 1, so that some positional deviation may occur with respect to the required teeming operation.

However, when the forward end portion of the body 1 is rendered laterally offset due to such a bend caused to the body 1, the bend is detected by the photoelectric switch 17*a* or 17*b* and, in response to a detection signal from the switch, the controller 16 operates to close the solenoid on-off valve 15*a* or 15*b*. Then, cooling water 18 is supplied only through the flow control valve 13*a* or 13*b* and accordingly the cooling water feed to the water-cooling jacket 10*a* or 10*b* at the offset side of the body 1 is decreased to lower the effect of cooling at that side. As a consequence, thermal expansion grows greater at the offset side of the body 1, so that the bend caused to the body 1 is automatically corrected. Thus, it is now possible to pour molten metal constantly into position in the mold.

Nextly, one example will be given to illustrate the effect of the foregoing arrangement. A teeming trough constructed as above described was employed in making cast iron pipes having a diameter of 200 mm. A total of 653 cast iron pipes of the above description was produced in 15 hours. No bend of body 1 was found during the process of casting with respect to the first 150 pipes. Solenoid on-off valves 15*a*, 15*b* were held in "on" condition, and cooling water feeds from cooling water feed pipes 12*a*, 12*b* were each maintained at 1 $m^3$/ h. During the casting operation for the 151st pipe, the body 1 was laterally bent 10 mm, which was detected by photoelectric switch 17*a*, whereupon solenoid on-off valve 15*a* was turned "off" and accordingly cooling water feed to the corresponding water cooling jacket 10*a* was limited to 0.5 $m^3$/ h or a feed rate set by flow control valve 13*a*. As a consequence, the bend of the body 1 was corrected to the original condition of the body 1. Upon return of the body 1 to its original condition, the solenoid on-off valve 15*a* was turned "on" and the original feed rate was restored.

Figure 5:
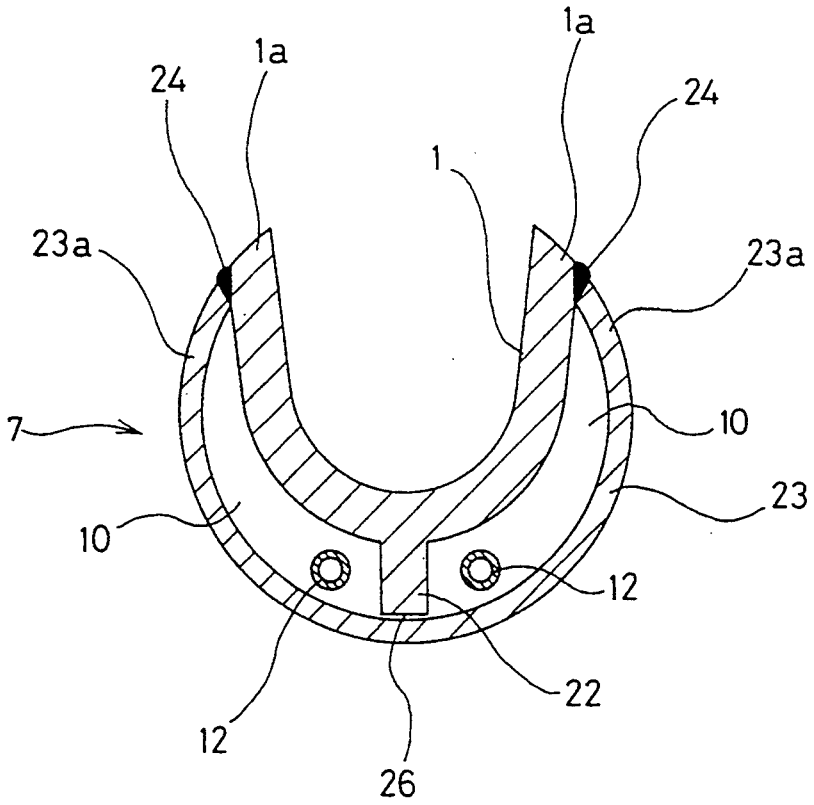
FIG. 5 is a transverse sectional view of a teeming trough representing a second embodiment of the invention.
Figure 6:
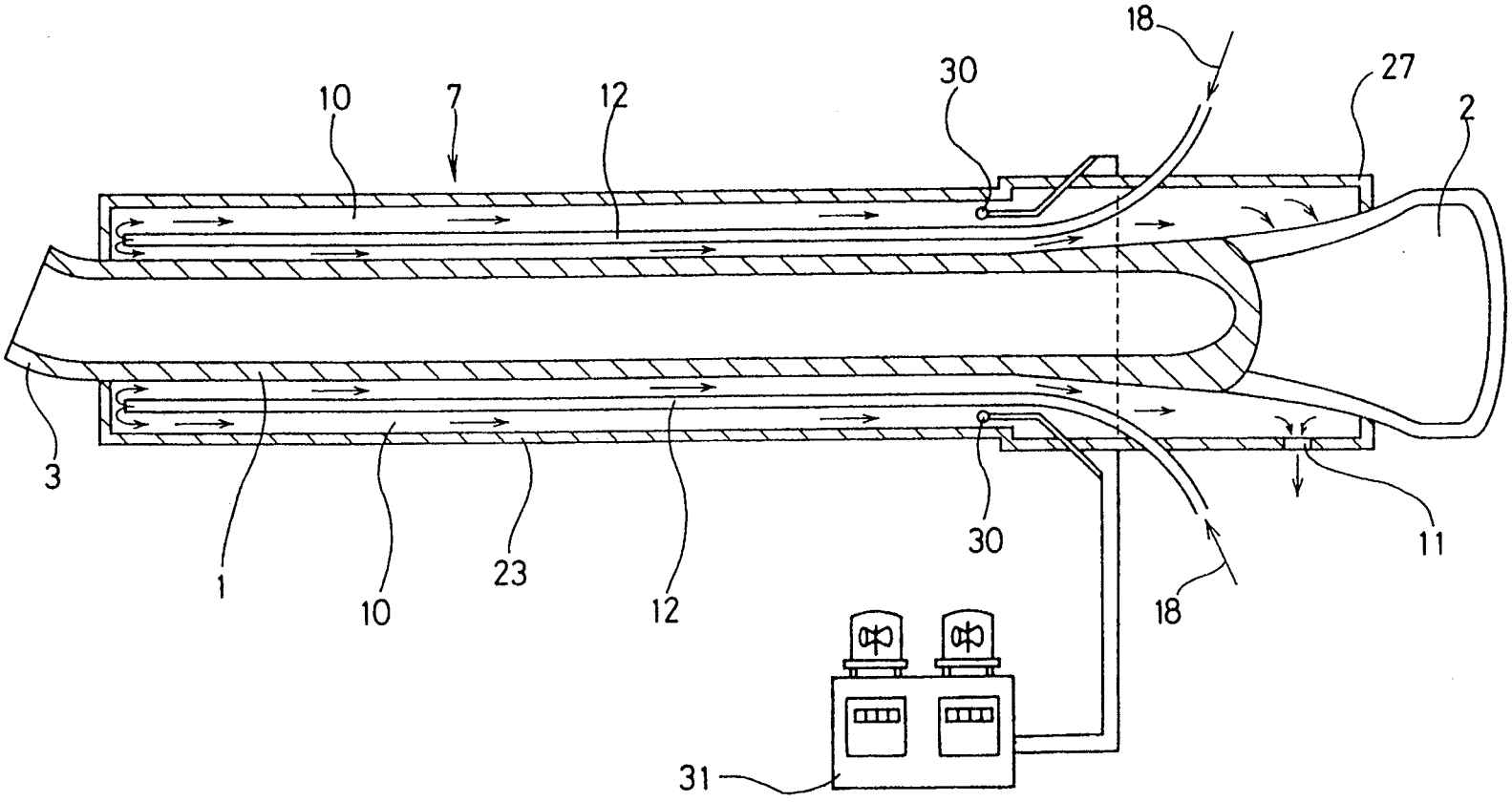
FIG. 6 is a reduced sectional view in plan of the teeming trough shown in FIG. 5.

FIGS. 5 and 6 illustrate a second embodiment of the invention. As shown, a body 1 is of a relatively thin metal construction and has a metal thickness generally uniformly distributed over its length. Further, the body 1 has a cross-sectional configuration of a top-open U shape. The body 1 has a rib 22 projecting downwardly from its bottom. A cover 23 having an arcuate configuration in cross section is provided to cover the outer side of the body 1, the cover 23 being rigidly fixed at opposite upper edges 23*a*, 23*a* thereof to the body 1 at corresponding upper edges 1*a*, 1*a* thereof via welds 24, 24. Through this arrangement there are defined water cooling jackets 10, 10 at both sides of the body 1. The water cooling jackets 10, 10 are in communication with each other via a clearance 26 defined between the lower end of the rib 22 and the cover 23.

Each water cooling jacket 10, at the base end side of the body 1, is in communication with a box 27, said box 27 being provided with a cooling water discharge port 11. Shown by 12 each is a cooling water feed pipe. Disposed at the border between each water cooling jacket 10 and the box 27 is a water temperature sensor 30 comprising a thermocouple which is connected to a water off-temperature alarm 31.

According to such arrangement, cooling water 18 flows in the same way as in the first embodiment shown in FIGS. 1 to 4. When the flow of cooling water 18 becomes stagnant to render the water temperature abnormally high, the off-temperature alarm 31 sounds an alarm so that the abnormality can be quickly coped with. The rib 22 functions as a cooling fin at the bottom of the body 1 and, in addition, it also serves to define water cooling jackets 10 at both sides thereof. Further, the clearance 26 between the lower end of the rib 22 and the cover 23 permits cooling water to flow therethrough. Therefore, the bottom of the body 1 is effectively cooled by cooling water 18. This cooling effect, coupled with the inherent reinforcing action of the rib 22, will inhibit cocking of the body 1. This serves to prevent any such trouble that, during a centrifugal casting operation, molten metal drops on the outer surface of the spigot of a cast iron pipe being made, thus causing a defect called "cold shut".

In the above described second embodiment, no recess for provision of an additive feed pipe therein is formed in the bottom of the trough. A third embodiment in which such a recess is provided will now be described with reference to FIG. 7.

Figure 7:
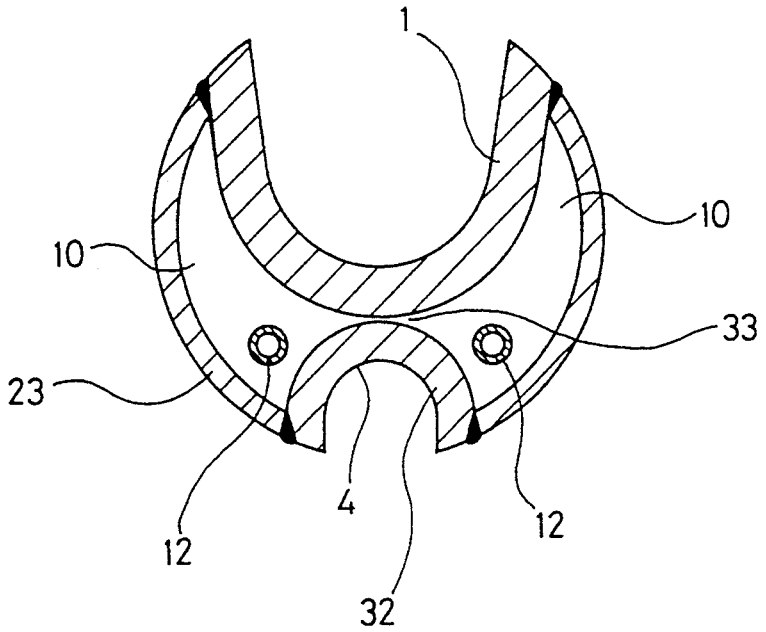
FIG. 7 is a transverse section of a teeming trough representing a third embodiment of the invention.

In FIG. 7, a body 1 comprises a member having a top-open U-shaped sectional configuration as in the second embodiment, the body 1 being covered with a cover 23 for defining water cooling jackets 10 in cooperation with the body 1. The cover 23 is centrally cut away, and a downwardly open, recess forming member 32 having an arcuate cross section is disposed in the cutaway portion along the length of the body 1 so as to form a recess 4 for provision of an additive feed pipe. A clearance 33 is defined between the body 1 and the recess forming member 32. The water cooling jackets 10 at opposite sides of the body 1 are in communication with each other through the clearance 33.

In this third embodiment as well, the bottom of the body 1 is effectively cooled by cooling water present in the clearance 33, so that upward warping of the body 1 is inhibited.

In connection with the foregoing, particular examples will be given. When cast iron pipes having a diameter of 200 mm were made using a teeming trough of the conventional solid type, an upward warping of about 50 to 65 mm was found with the tip of spout 3 at the end of casting ( when feeder was applied to the spigot of a cast iron pipe). In contrast, such warping was limited to 5 to 10 mm in the case of the second embodiment of the invention, and about 5 mm in the case of the third embodiment.

Figure 8:
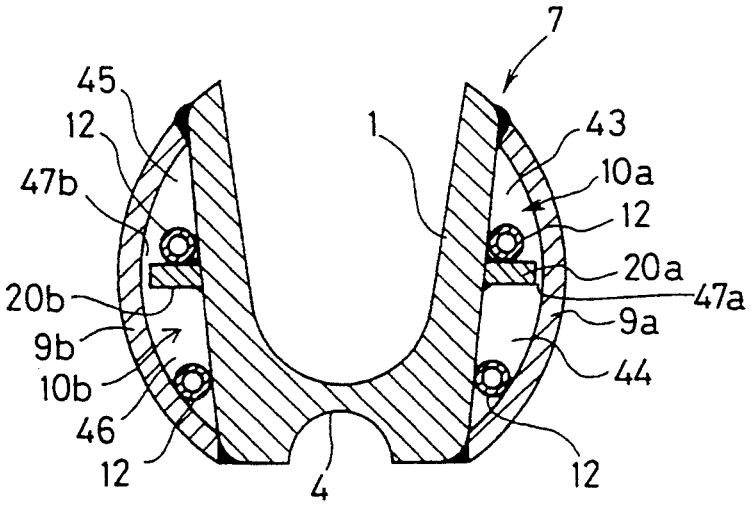
FIG. 8 is a transverse section of a teeming trough representing a fourth embodiment of the invention.

FIG. 8 shows a fourth embodiment of the invention. As is the case with the first embodiment, a body 1 has a cross sectional configuration of U shape and is covered at both outer sides thereof with covers 9*a*, 9*b* having an arcuate cross sectional configuration. A pair of water cooling jackets 10*a*, 10*b* of enclosed construction is defined between sides of the body 1 and the covers 9*a*, 9*b*, the jackets 10*a*, 10*b* extending along the length of the body 1. At the inner side of each cover 9*a*, 9*b* or within each water cooling jacket 10*a*, 10*b*, there is provided a plate-like partition member 20*a*, 20*b* which projects laterally from the surface of a heightwise midportion of the body 1 toward the inner surface of the cover 9*a*, 9*b*, the partition member 20*a*, 20*b* extending along the length of the body 1.

The interior spaces of the cooling water jackets 10*a*, 10*b*are partitioned by the partition members 20*a*, 20*b* into four compartments, namely, an upper compartment 43 and a lower compartment 44 on the one jacket side and an upper compartment 45 and a lower compartment 46 on the other jacket side. A clearance 47*a*, 47*b* is defined between the side edge of the partition member 20*a*, 20*b* and the inner surface of the cover 9*a*, 9*b*. Cooling water feed pipes 12, 12 . . . are installed respectively in the compartments 43, 44, 45, 46. At a location outside the trough, each cooling water feed pipe 12 is fitted with a cooling water flow control element of the type as shown in FIG. 1.

According to such arrangement, when cooling water is caused to flow in each cooling water feed pipe 12 during the process of molten metal teeming, the cooling water is released from the opening of the feed pipe 12 at the forward end thereof into the compartment 43, 44, 45, 46. Then, the cooling water flows in that portion of the compartment 43, 44, 45, 46 which is located outside the cooling water feed pipe 12, toward the base end side of the body 1.

As in the earlier described embodiments, the body 1 of the trough may be subject to upward warping during the process of casting. It is also possible that the surface level of the molten metal flowing within the body 1 may vary according to the diameter of a cast pipe to be made, with the result that some thermal deformation may occur to cause vertical warping to the body 1. In order to cope with such a possible trouble, cooling water feeds in respective cooling water pipes are controlled so as to previously limit cooling water feeds to those of the upper compartments 43, 45 and lower compartments 44, 46 which are located on that side of the body 1 which is expected to be rendered offset, thereby to give some lower cooling effect with respect to those compartments. As a consequence of this arrangement, thermal expansion of that side of the body 1 which tends to be offset will become larger, so that any vertical warping, if caused to the body 1, may be effectively corrected.

Examples will be given. In making cast iron pipes having a diameter of 300 mm, in which upward warping is likely to occur because the surface level of molten metal flow in body 1 is relatively high, the cooling water flow in upper compartments 23, 25 was limited to 600 liters/hour, whereas the cooling water flow in lower compartments 44, 46 was kept at 1100 liters/-hour. Again, in making cast iron pipes having a bore diameter of 600 mm which are likely to suffer the trouble of downward warping because the surface level of molten metal flow in body 1, the cooling water flow in upper compartments was kept at 1300 liters / hour, whereas the cooling water flow in lower compartments 44, 46 was limited to 950 liters/hour. Under the above noted cooling conditions, upward or downward warping encountered with body 1 was limited to a warpage of about 15 mm upward at the forward end of the trough at the end of casting operation. Same warpage was observed with both 300 mm diameter and 600 mm diameter cast iron pipes.

In same way as in the first embodiment, a photoelectric switch or the like sensor which is capable of detecting warpage may be employed for adjusting the cooling water flow on the basis of a detection output of the sensor, whereby any upward or downward body warpage may be effectively corrected. Further, through relative adjustment of the cooling water flow in one side compartments 43, 44 and that in the other side compartments 45, 45 it is possible to correct any lateral thermal deformation caused to the body 1, in same way as in the first embodiment.

What is claimed is:

1. A teeming trough for pouring molten metal into a mold comprising a horizontally extending body for pouring molten metal, water cooling jackets formed at both sides of the body, cooling-water feed paths for supplying cooling water into the water cooling jackets, means for adjusting cooling water feeds in the respective cooling-water feed paths, means for detecting a lateral bend of the body, and means for controlling the cooling-water feed adjusting means on the basis of a detection signal from the bend detecting means in such a manner that the cooling water feed to the water cooling jacket at the bent side of the body is decreased to lower the effect of cooling at the bent side.

2. A teeming trough as set forth in claim 1, wherein each of the cooling-water feed paths is comprised of a pipe, said pipe being inserted into each of the water cooling jackets at a base end portion of the body and extending through the water cooling jacket toward the forward end of the body, the pipe being open at the forward end of the body.

3. A teeming trough as set forth in claim 1, wherein the means for adjusting cooling water feeds include a flow control valve and an on-off valve which are arranged in parallel in a portion of each cooling-water feed path which is located outside the trough, and wherein the control means is operative to on-off control said on-off valve.

4. A teeming trough for pouring molten metal into a mold comprising a horizontally extending body having a cross-sectional configuration of a top-open U shape for enabling molten metal teeming, a cover encompassing the outer side of the body, a water cooling jacket defined between the body and the cover in such a way as to permit cooling water to contact a substantially entire surface of the body extending along the cross section of the body, a rib projecting downwardly from the bottom of the body, and a clearance defined between the rib and the cover.

5. A teeming trough as set forth in claim 4, wherein the portion of the cover which corresponds to the bottom of the U-shaped body is cut away and a recess forming member having an arcuate cross-sectional configuration and extending along the length of the body is disposed in the cutaway portion, the recess forming member having a recess for disposing an additive feed pipe, and wherein a clearance is defined between the recess forming member and the body.

6. A teeming trough for pouring molten metal into a mold comprising a horizontally extending body for pouring molten metal, water cooling jackets formed at opposite sides of the body respectively, means for partitioning the interior space of each of the water cooling jackets into two compartments, upper and lower, cooling water feed paths for supplying cooling water into respective cooling compartments, means for adjusting cooling water feeds in the respective cooling water feed paths, means for detecting lateral and/or vertical bend of the body, and means for controlling the cooling water feed adjusting means on the basis of a detection signal from the bend detecting means in such a manner that the cooling water feed to the water cooling compartments at a bent side of the body is decreased to lower the effect of cooling at the bent side.

* * * * *